US006135214A

United States Patent [19]

Last

[11] Patent Number: 6,135,214

[45] Date of Patent: Oct. 24, 2000

[54] IMPACT ABSORBING FLUID OPERATED HAMMER

[75] Inventor: Anthony Edward Walter Last, Charlotte, N.C.

[73] Assignee: International Construction Equipment, Inc., Matthews, N.C.

[21] Appl. No.: 09/228,437

[22] Filed: Jan. 11, 1999

[51] Int. Cl.[7] ..... B25D 9/00

[52] U.S. Cl. ..... 173/211; 173/128; 173/131

[58] Field of Search ..... 173/210, 211, 173/162.1, 128, 49, 131

[56] References Cited

U.S. PATENT DOCUMENTS

| | | | |
|---|---|---|---|
| 3,550,694 | 12/1970 | Gawlik et al. | 173/210 |
| 3,583,499 | 6/1971 | Cordes et al. | 173/131 |
| 4,465,145 | 8/1984 | Kuhn | 173/131 |
| 4,506,744 | 3/1985 | Dawson | 173/131 |
| 4,703,838 | 11/1987 | Roussin et al. | 173/210 |
| 5,117,924 | 6/1992 | Bermingham | 173/131 |
| 5,285,858 | 2/1994 | Okada et al. | 173/211 |
| 5,878,823 | 3/1999 | Henriksson | 173/210 |

*Primary Examiner*—Scott A. Smith

*Attorney, Agent, or Firm*—Kennedy Covington Lobdell & Hickman

[57] ABSTRACT

An impact hammer having a non-mechanical connection between the driving piston rod and the impact ram. The non-mechanical connection includes an annular body portion connected to the lower end of the piston rod which is received in a cavity in the top surface of the impact ram, and an elastomeric ring is held in facing grooves in the cavity and the annular body member to constitute the sole connecting element between the piston rod and the impact ram.

12 Claims, 6 Drawing Sheets

IMPACT ABSORBING FLUID OPERATED HAMMER

BACKGROUND OF THE INVENTION

This invention relates generally to fluid powered hammers, and in particular to fluid powered hammers having an impact ram driven by a piston rod of a fluid operated motor for driving piles, breaking rock and pavement, and fill compaction, and similar high-impact related applications.

In typical fluid powered hammers of the aforesaid type, the impact ram is arranged to move generally vertically, such as on a plurality of guide bars, and a hydraulic or pneumatic cylinder has a piston that is connected directly to the impact ram for raising the ram and then driving it downwardly with considerable force to provide an impact force on the object, such as a pile that is being driven into the ground.

To effectuate its intended purpose, the impact ram must have a high level of kinetic energy when it strikes the pile or other object, and, as a result, the impact force transmitted from the piston rod to the impact ram must be a least partially dissipated to avoid damage to the equipment.

In known fluid operated hammers of this type, some form of resilient connection between the piston rod and the impact ram is provided to dissipate the kinetic energy of the piston rod at the point of impact, and such resilient connections take a variety of forms, but in each case the connection is a mechanical connection. For example, in some fluid operated hammers, the piston rod is attached directly to the impact ram using a flange that is sandwiched between a plurality of stacked Belleville washers or similar elastomeric washers in an assembly that is held together by a mechanical connection consisting of a plate held in place by a plurality of bolts.

Another well known arrangement for driving the impact ram consist of a pair of lift cylinders having piston rods disposed externally of the impact ram and mechanically connected to the sides of the impact ram using lift brackets, and a connecting bolt assembly having some form of resilient members to partially dissipate the impact forces transmitted to the impact ram.

While such mechanical connections of this type do act to dissipate some of the severe shock loads that are transmitted between the piston rod and the impact ram by virtue of the Belleville washers or similar elastomeric members, the bolts forming the mechanical connection between the piston rod and impact ram bear the brunt of the severe shock waves created when the impact ram strikes a pile or the like, and, as a consequence, these mechanical connections become loosened or defective in a relative short period of time because of the constant pounding action of the impact ram and the strain waves created by the impact forces generated by the impact ram, and because of the violent accelerations and decelerations of the impact ram in normal usage. Therefore, these mechanical connections must be repaired or replaced on a regular basis, which increases the expense of operating the fluid operated hammer, and the equipment is out of service while it is subject to such maintenance.

In accordance with the present invention, a fluid operated hammer of the aforesaid type is provided which eliminates the mechanical connection between the impact ram and the driving piston rod and the drawbacks associated therewith as described above.

SUMMARY OF THE INVENTION

The present invention provides a fluid power operated hammer that includes a fluid-operated cylinder, a piston rod attached thereto, and an impact ram which is driven by the cylinder and the piston rod for impacting a desired object, and it includes an improvement comprising a non-mechanical connection between the piston rod and the impact ram. This non-mechanical connection includes an annular body portion attached to one end of the piston rod and having an exterior surface portion formed with a first groove therein. A cavity is formed in the impact ram for receiving therein the annular body portion, such cavity including a wall portion disposed adjacent the exterior surface of the annular body portion, and being formed with a second groove therein disposed in facing relation to the first groove in the annular body portion. A ring formed of resilient material is captured within both the first and second facing grooves for transmitting forces between the piston rod and the impact ram, such ring being the sole connection between the piston rod and the ram for transmitting at least the major driving force between the piston rod and the impact ram.

In the preferred embodiment of the present invention, the ring includes first and second end ring portions formed of a relatively stiff material, such as nylon, and includes an inner ring portion sandwiched between said first and second end ring portions and formed of an elastomeric material, such as polyurethane.

Also, in the preferred embodiment, the annular body portion is formed with upper and lower end portions connected together by bolts for moving said upper and lower portions toward and away from one another, and an intermediate portion is disposed between said upper and lower portions, whereby the bolts are tightened to move the upper and lower portions toward one another, the resilient ring member will substantially fill the space formed by the first and second grooves, except for an expansion chamber provided at such space.

The intermediate portion of the annular body portion of the impact ram may be formed with an interior groove, and may be attached to the piston rod by an annular connector plate mounted on one end of the piston rod and extending into the interior groove portion with a part of the intermediate annular body portion being disposed between the annular connector plate and the upper and lower end portions.

In accordance with another feature of the fluid operated hammer of the present invention, a valve operating rod is attached to the impact ram utilizing a connector assembly fixed to the valve operating rod and extending into an opening in the impact ram, the connector assembly including a connecting ring of elastomeric material fixed therein and disposed within a groove formed in the ram opening and providing the sole connecting element for connecting the valve operating rod to the impact ram. The connector assembly may include a pair of generally rigid plate members disposed above and below the connecting ring and in contact therewith, and a connecting bolt for moving the pair of plate members toward one another to compress and deform the connecting ring to substantially fill the groove formed in the impact ram opening.

DESCRIPTION OF THE PREFERRED EMBODIMENT

Figure 1:
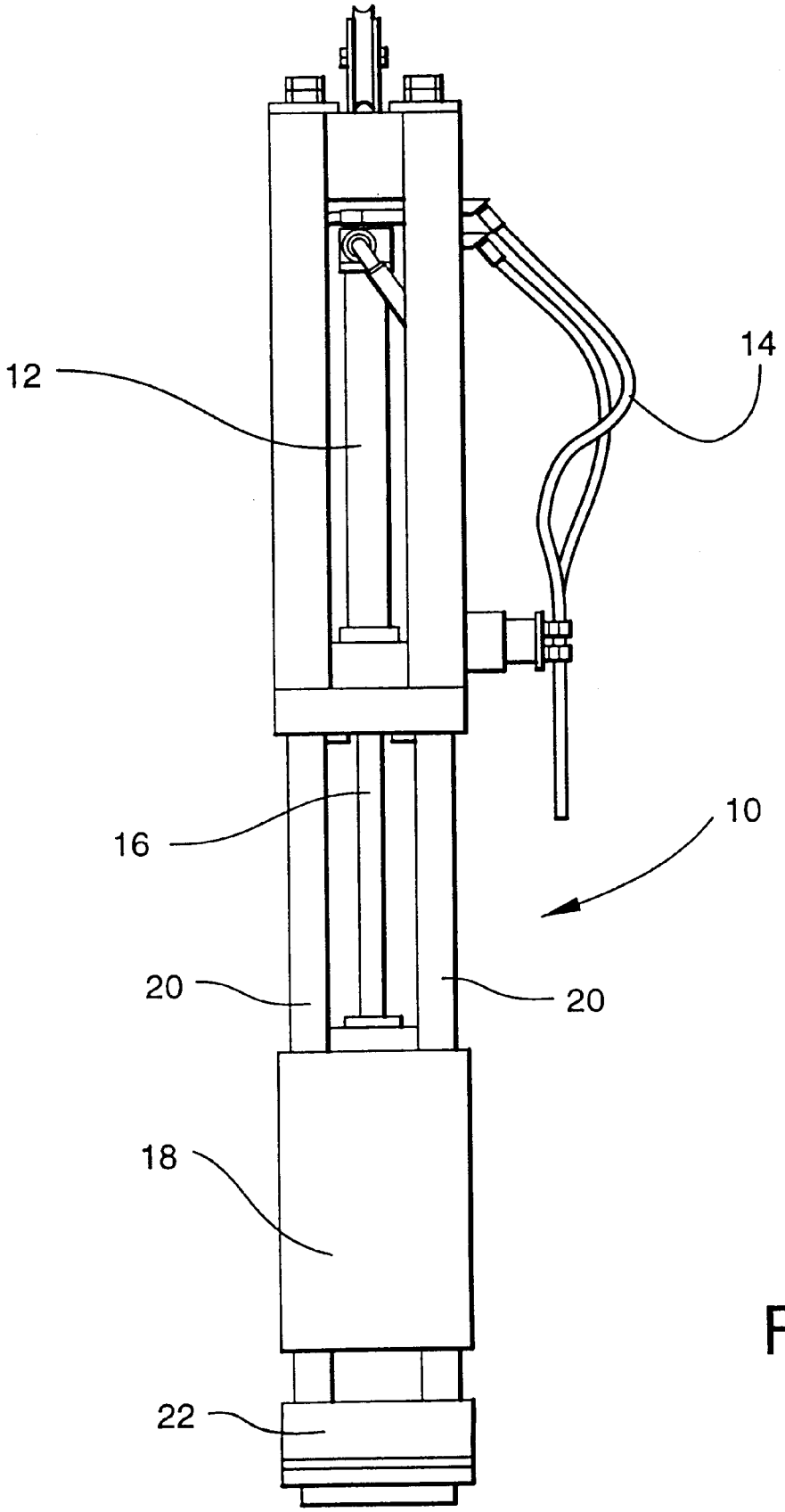
FIG. 1 is a vertical view of a fluid operated hammer embodying the present invention.

Looking now in greater detail at the accompanying drawings, FIG. 1 illustrates a typical impact hammer 10 embodying the present invention, and this impact hammer is entirely conventional except for the non-mechanical connection between the piston rod and the impact ram, and the non-mechanical connection between the impact ram and the valve operating rod, all as will be explained in greater detail below.

Figure 3:
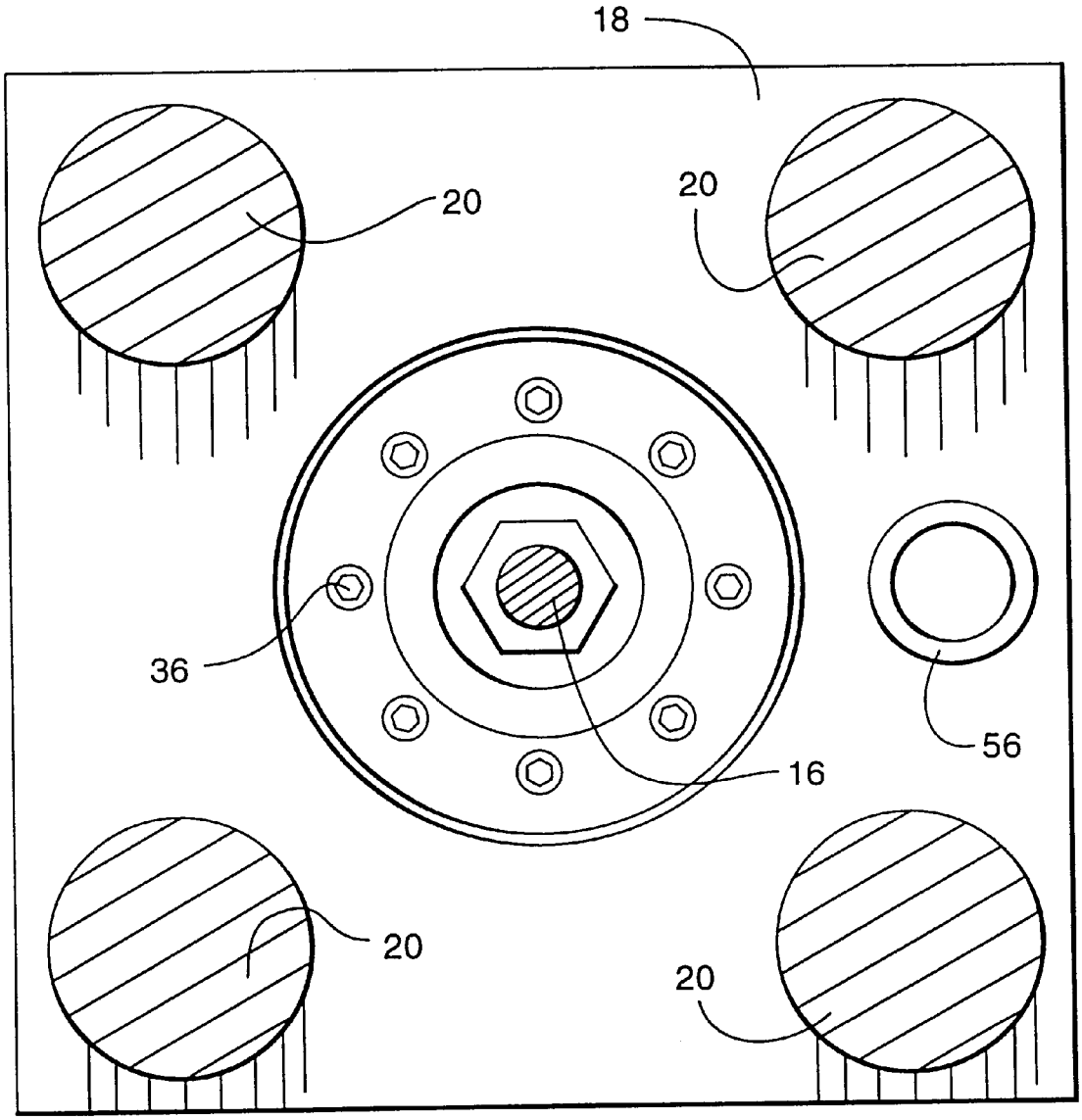
FIG. 3 is a top view of the impact ram of the fluid operated hammer illustrated in FIG. 1.

The impact hammer 10 includes a hydraulic cylinder 12 having inlet and outlet fluid conduits 14 for operating the hydraulic cylinder in a conventional manner, and the hydraulic cylinder 12 is connected to a piston rod 16 which, in turn, is connected to an impact ram 18 in a manner to be described presently. The impact ram is arranged for vertical movement on four guide rods 20 located adjacent the corners of the impact ram (see FIG. 3), and a support collar 22 is provided to engage the object to be driven or otherwise impacted, such as a pile which is driven into the ground.

In operation, fluid is introduced into the hydraulic cylinder 12 through one of the conduits 14 to raise the piston rod 16 and the impact ram 18 attached thereto to a raised position, after which the fluid input to the hydraulic cylinder 12 is reversed and the impact ram 18 is driven downwardly with considerable force until it impacts the support member 22 or the pile on which the support member 22 is mounted to provide the desired impact. It will be appreciated that the constant pounding of the impact ram 18, and the violent acceleration thereof, creates significant shock waves and strain waves as described above, and these forces are particularly manifested at the connection between the piston rod 16 and the impact ram 18.

Figure 4:
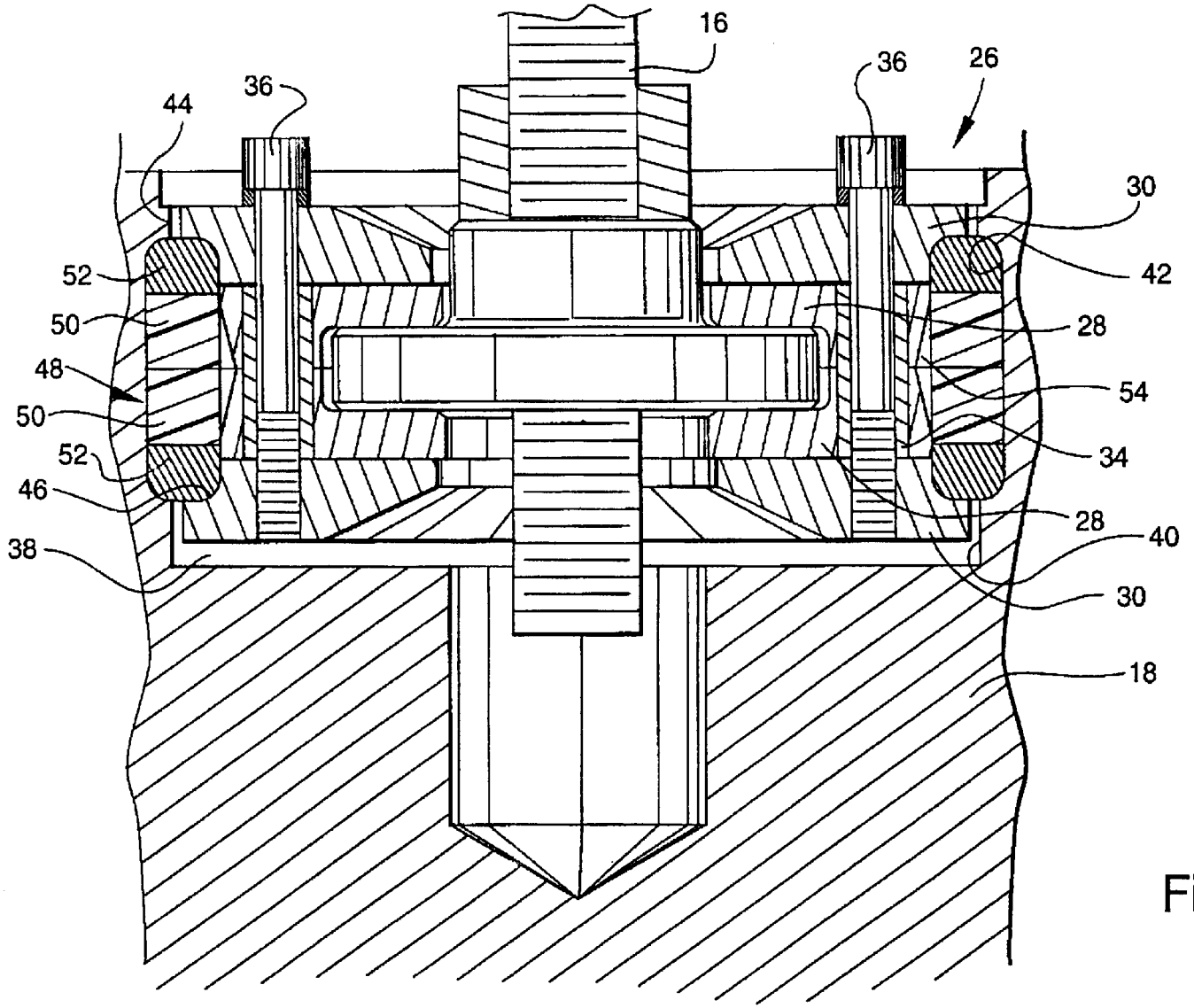
FIG. 4 is a vertical section view taken through the impact ram and illustrating the non-mechanical connection between the impact ram and the piston rod for driving the impact rams with the non-mechanical connection in its uncompressed state.

As best seen in FIGS. 2–5, the present invention provides a unique nonmechanical connection between the piston rod 16 and the impact ram 18. More specifically, the bottom end of the piston rod 16 has an annular connector plate 24 mounted thereon, and an annular body member 26 is carried on the connector plate 24. The annular connector plate 24 is sandwiched between two identical intermediate plate members 28 which are preferably formed of nylon, but which may be formed of any other material suitable for the particular application of the impact hammer 10, including steel. However, nylon is generally preferred because it eliminates the need for lubrication, and also eliminates the need to harden the steel. The intermediate plates 28 are, in turn, sandwiched between a pair of end plates 30. As best seen in FIG. 4, a plurality of bushings 34 are located in openings in the intermediate plates 28, and an equal number of connecting bolts 36 extend through the bushings 34, and the end plates 30, to thereby form the annular body portion 26 attached to the bottom of the piston rod 16.

The upper surface of the impact ram 18 is formed with a cavity 38, and, as best seen in FIG. 4, the annular body portion 26 is received within the cavity 38. The cavity 38 includes a vertically extending wall portion 40 that is formed with an annular groove 42, and the exterior surface 44 of the annular body portion of the flange member 26 also includes an inner groove 46 that is formed in the radially exterior portions of the two end plates 30, and the grooves 42 and 46 are disposed in facing relation to one another as best seen in FIG. 4.

A ring member 48 formed of the elastomeric material is captured within the space defined by the facing grooves 42 and 46. This ring member 48 may be formed of any suitable elastomeric material, but it has been found that particularly good results are obtained if the ring member 48 is formed of two innermost ring segments 50 formed of polyurethane, and two outermost ring segments 52 formed of any grade of nylon. The inner ring segments 50 are positioned adjacent an expansion groove 54 formed in the annular exterior surface of the intermediate plates 28 for a purpose to be described in greater detail presently.

Figure 2:
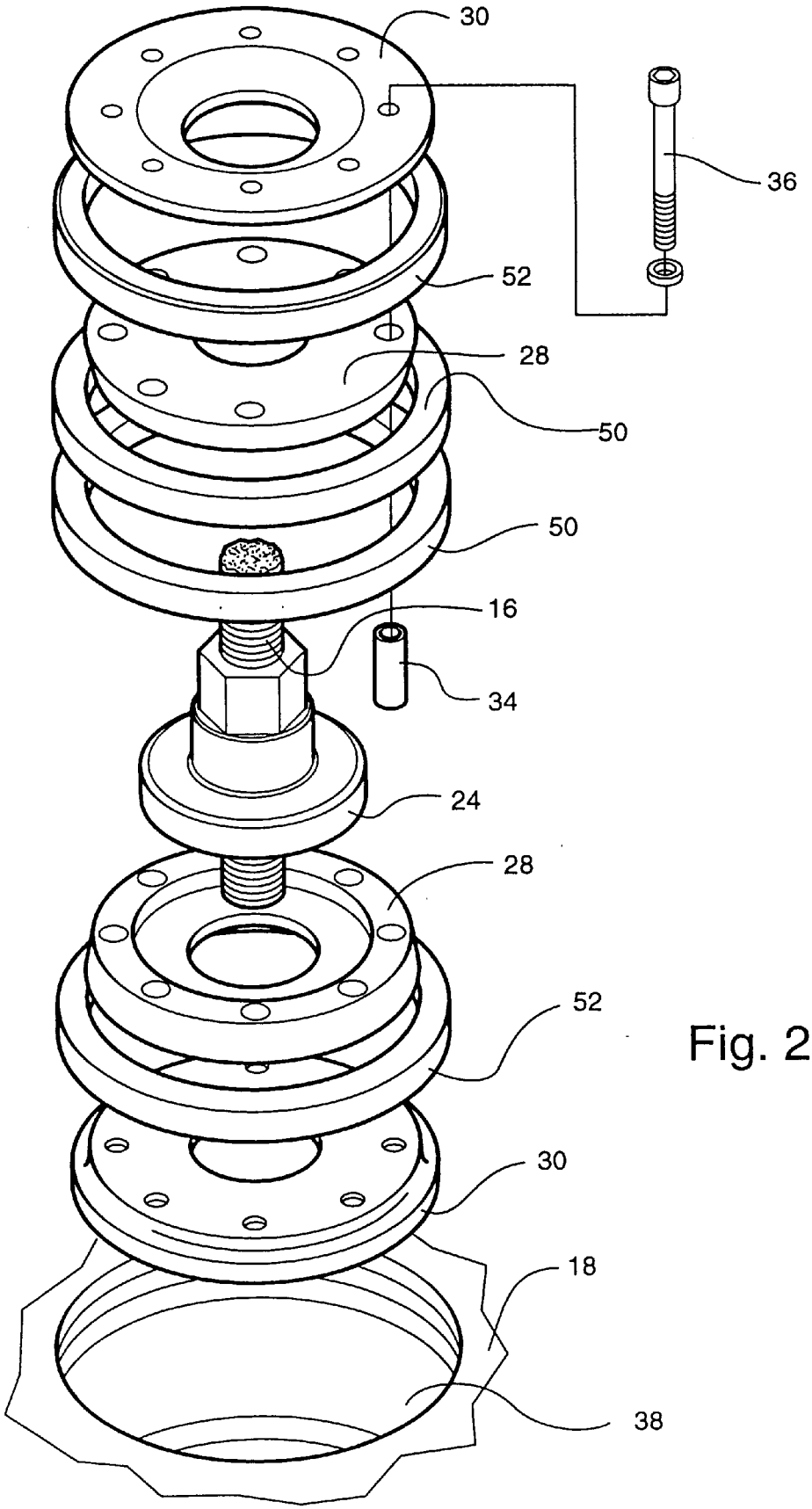
FIG. 2 is an exploded view showing the components of the impact ram.
Figure 5:
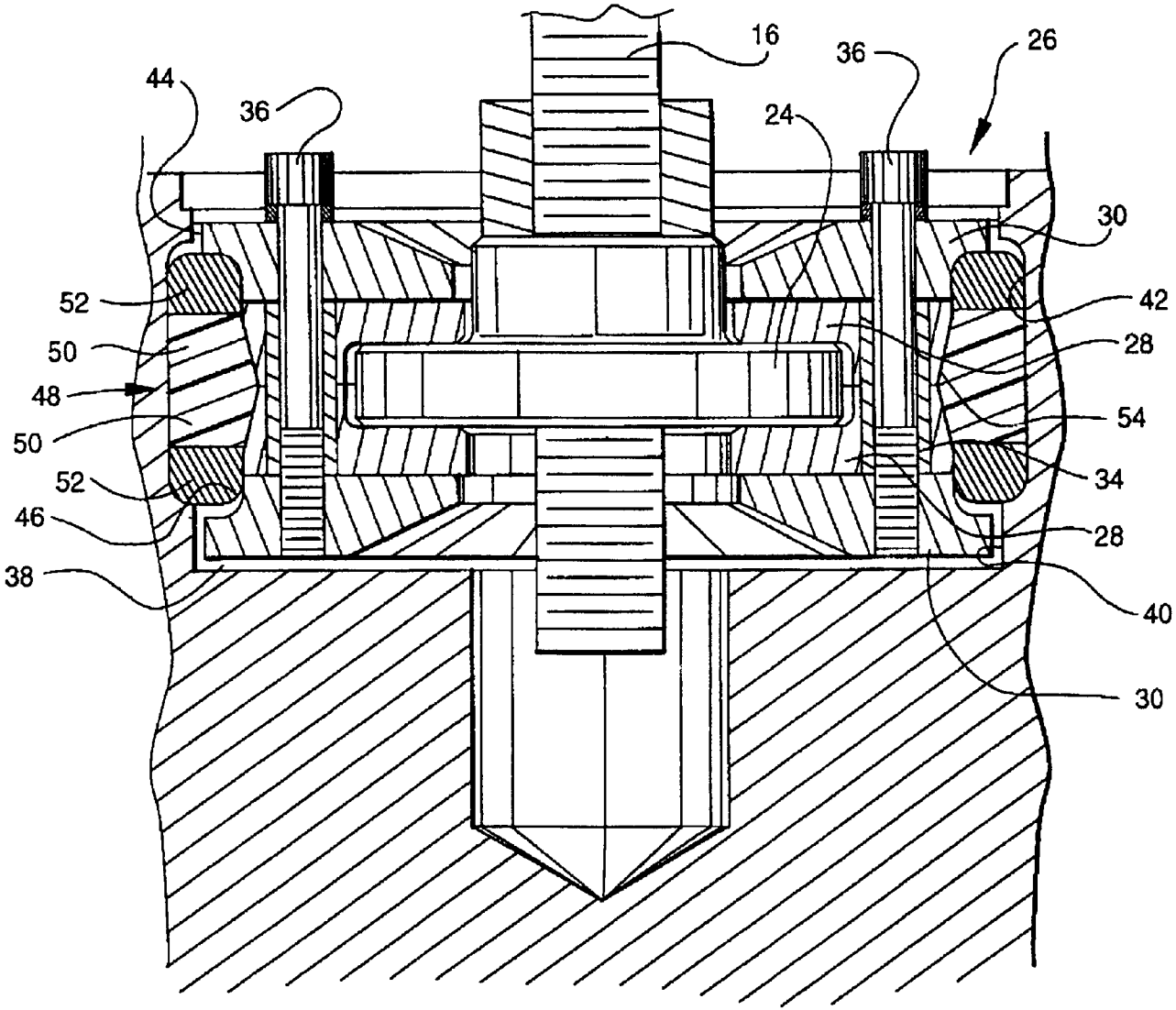
FIG. 5 is a vertical section view like FIG. 4 but with the non-mechanical connection shown in its compressed state.

Looking at FIG. 2, it will be noted that the ring member 48 constitutes the sole connection between the annular body portion 26 and the impact ram 18, and because the ring member 48 is formed of an elastomeric material, it constitutes a nonmechanical connection between the piston rod 16 and the impact ram 18. More specifically, the elastomeric ring member 48 will maintain the impact ram 18 connected to the piston rod 16 in the general position illustrated in FIG. 4 during the rapid downward acceleration of the impact ram 18 caused by the hydraulic cylinder 12 and the piston rod 16. However, when the impact ram 18 violently impacts the support member 22, the ring member 48 effectively dissipates the shock waves caused by this impact force because it permits relative movement between the piston rod 16 and the impact ram 18, as illustrated in FIG. 5.

More particularly, at the point of impact, the impact ram 18 will obviously stop abruptly, but the ring member 48 permits some cushioned relative movement of the annular body portion 26 within the cavity 38 of the impact ram 18. The upper portion of the inner groove 46, which is formed in the uppermost end plate 30, pushes downwardly on the ring member 48, and the ring member 48 is compressed and expands into the expansion groove 54, as illustrated in FIG. 5, to absorb and dissipate the impact force between the piston rod 16 and the impact ram 18.

Additionally, it will be noted that when the piston rod 16 is moved upwardly for a return stroke by the hydraulic cylinder 12, the heavy weight of the static impact ram 18 also creates a force that is dissipated by the ring member 48 operating in an opposite direction. When the piston rod 16 and the annular body portion 26 begins to move upwardly, the portion of the inner groove 46 formed in the lowermost end plate 30 will compress the ring member 48 against the upper end of the groove 42 in the impact ram to cause the ring member 48 to be compressed into the expansion groove 54 and thereby absorb and dissipate the upwardly directed force of the piston rod 16 and the annular body portion 26 relative to the impact ram 18.

Figure 6:
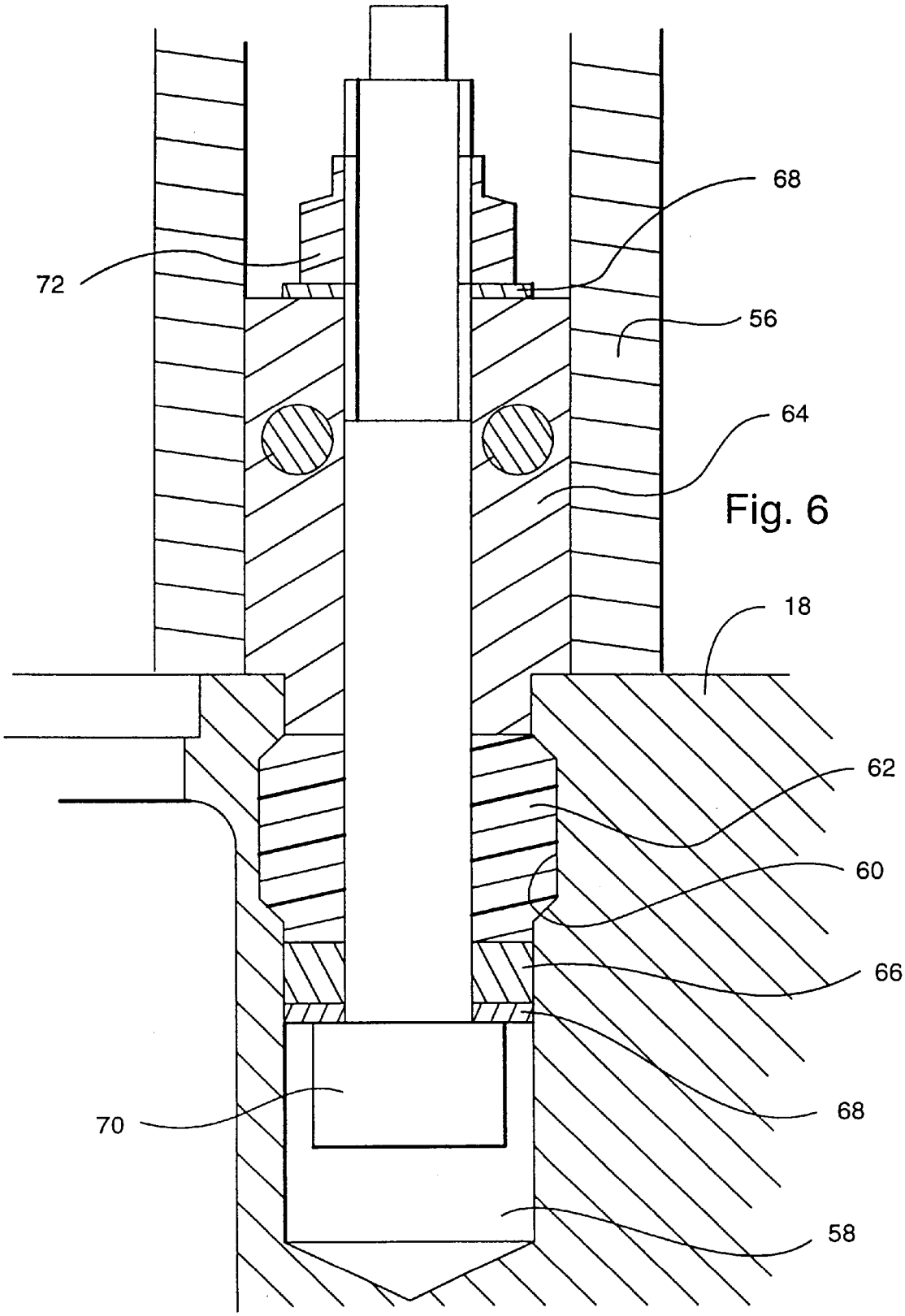
FIG. 6 is a vertical section view taken through another part of the impact ram and illustrating the non-mechanical connection of a valve operating rod to the impact ram.

In accordance with another feature of the present invention, a conventional valve operating rod 56 is secured within an opening 58 formed in the upper surface of the impact ram 18 as best seen in FIG. 6. This valve operating rod 56 extends upwardly from the impact ram 18 and is movable therewith so that when the impact ram 18 reaches its uppermost position the valve operating rod will engage a conventional valve actuator (not shown) associated with the hydraulic cylinder 12 to change the direction of the hydraulic fluid being introduced to the hydraulic cylinder through the conduits 14, and thereby reverse the direction of movement of the impact ram 18, all in a conventional and well known manner.

However, because the valve operating rod 56 is carried on the impact ram 18, it is also subjected to the violent impact force when the impact ram 18 strikes the support member 22.

To dissipate this impact force, a non-mechanical connection is provided between the impact ram 18 and the valve operating rod 56 as illustrated in FIG. 6. This non-mechanical connection includes an annular groove 60 formed in the opening 58, and an elastomeric ring element 62 attached to the valve operating rod 56 through a connector assembly that includes a pair of nylon bushing elements 64 and 66 located on opposite sides of the ring element 62, a pair of steel washers 68 located on the exterior surfaces of the bushings 64, 66, and a bolt 70 threaded into a locknut 72 to maintain all of the aforesaid elements in place.

Again, it will be noted that the only connection between the impact ram 18 and the valve operating rods 56 is the non-mechanical elastomeric ring element 62. Accordingly, the impact force between the valve operating rod 56 and the impact ram 18 at the point of impact is absorbed and dissipated by the elastomeric ring element 62, and, similarly, the force component imposed on the valve operating rod 56 during the initial upward movement of the impact ram 18 will also be absorbed and dissipated by the elastomeric ring element 62.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adapations, variations, modifications and equivalent arrangements, the present invention being limited only by the claims appended hereto and the equivalents thereof.

What is claimed is:

1. In a fluid power operated hammer that includes a fluid-operated cylinder, a piston rod attached thereto, and an impact ram which is driven by said cylinder and said piston rod for impacting a desired object, the improvement comprising a non-mechanical connection between said piston rod and said impact ram which includes:

(a) a body portion attached to one end of said piston rod and having an exterior surface portion formed with a first generally annular-shaped groove therein;

(b) a cavity formed in said impact ram for receiving therein said body portion, said cavity including a wall portion disposed adjacent said exterior surface of said body portion at a predetermined spacing therefrom and being formed with a second generally annular-shaped groove therein disposed in facing relation to said first groove in said body portion; and (c) a ring formed of resilient material and captured within both said first and second facing grooves for transmitting forces between said piston rod and said impact ram, said ring being the sole connection between said piston rod and said impact ram for transmitting at least the major driving force between said piston rod and said impact ram, and said ring having an axial thickness which is greater than said predetermined spacing between said cavity wall portion and said exterior surface of said body portion.

2. A fluid operated hammer as defined in claim 1, wherein said ring includes first and second end ring portions formed of a relatively stiff material, and includes an inner ring portion sandwiched between said first and second end ring portions and formed of an elastomeric material.

3. A fluid operated hammer as defined in claim 2, wherein said first and second end ring portions are formed of nylon, and said inner ring portion is formed of polyurethane.

4. A fluid operated hammer as defined in claim 1, wherein said body portion is annular, and said annular body portion is formed with upper and lower end portions connected together by bolts for moving said upper and lower end portions toward and away from one another, and an intermediate portion disposed between said upper and lower portions, whereby when said bolts are tightened to move said upper and lower portions toward one another, said resilient ring member will be held between said first and second grooves.

5. A fluid operated hammer as defined in claim 4, wherein said intermediate portion of said annular body portion is formed with an interior groove, and wherein said annular body portion is attached to said piston rod by an annular connector plate mounted on said one end of said piston rod and extending into said interior groove of said annular body portion with a part of said intermediate annular body portion being disposed between said annular connector plate and said upper and lower end portions.

6. A fluid operated hammer as defined in claim 1, wherein a valve operating rod is attached to said impact ram, the improvement further including an opening formed in said impact ram and a groove formed in the wall of said opening, and a connector assembly fixed to said valve operating rod and extending into said opening in said impact ram, said connector assembly including a connecting ring of elastomeric material fixed therein and disposed within said groove formed in said impact ram opening and providing the sole connecting element for connecting said valve operating rod to said impact ram.

7. A fluid operated hammer as defined in claim 6, wherein said connector assembly includes a pair of generally rigid plate members disposed above and below said connecting ring and in contact therewith, and a connecting bolt for moving said pair of plate members toward one another to compress said connecting ring to substantially fill said groove formed in said ram impact opening.

8. In a fluid power operated hammer that includes a fluid-operated cylinder and a piston rod attached thereto, and an impact ram which is driven by said cylinder and said piston rod for impacting a desired object, the improvement comprising a nonmechanical connection between said piston rod and said impact ram which includes:

(a) an annular body portion presenting an exterior annular surface having a first groove formed therein, and having upper and lower end portions connected together by bolts for moving said upper and lower portions toward and away from one another, and an intermediate portion disposed between said upper and lower portions;

(b) a connector ring attached one end of said piston rod and being contained within said intermediate portion of said annular body portion;

(c) a cavity formed in said impact ram for receiving therein said annular body portion, said cavity including a wall portion disposed adjacent said exterior surface of said annular body portion and being formed with a generally annular-shaped groove therein disposed in facing relation to said first groove in said annular body portion; and (d) a resilient ring disposed between said facing first and second grooves to be retained therein, said resilient ring constituting the sole connection between said piston rod and said impact ram for transmitting at least the major driving force between said piston rod and said impact ram.

9. A fluid operated hammer as defined in claim 8, wherein a valve operating rod is attached to said impact ram, the improvement further including an opening formed in said impact ram and a groove formed in the wall of said opening, and a connector assembly fixed to said valve operating rod and extending into said opening in said impact ram, said connector assembly including a connecting ring of elastomeric material fixed therein and disposed within said groove formed in said impact ram opening and providing the sole connecting element for connecting said valve operating rod to said impact ram.

10. A fluid operated hammer as defined in claim 9, wherein said connector assembly includes a pair of generally rigid plate members disposed above and below said connecting ring and in contact therewith, and a connecting bolt for moving said pair of plate members toward one another to compress and deform said connecting ring to substantially fill said groove formed in said impact ram opening.

11. In a fluid power operated hammer that includes a fluid-operated cylinder, a piston rod attached thereto, and an impact ram which is driven by said cylinder and said piston rod for impacting a desired object, the improvement comprising a non-mechanical connection between said piston rod and said impact ram which includes:

(a) a body portion attached to one end of said piston rod and having an exterior surface portion formed with a first groove therein;

(b) a cavity formed in said impact ram for receiving therein said body portion, said cavity including a wall portion disposed adjacent said exterior surface of said body portion at a predetermined spacing therefrom and being formed with a second groove therein disposed in facing relation to said first groove in said body portion; and (c) an intermediate connecting member formed of resilient material and captured within both said first and second facing grooves for transmitting forces between said piston rod and said impact ram, said intermediate connecting member being the sole connection between said piston rod and said impact ram for transmitting at least the major driving force between said piston rod and said impact ram, and said intermediate connecting member having an axial thickness which is greater than said predetermined spacing between said cavity wall portion and said exterior surface of said body portion.

12. In a fluid power operated hammer that includes a fluid-operated cylinder, a piston rod attached thereto, and an impact ram which is driven by said cylinder and said piston rod for impacting a desired object, the improvement comprising a non-mechanical connection between said piston rod and said impact ram which includes:

(a) a body portion attached to one end of said piston rod and having an exterior surface portion formed with a first groove therein;

(b) a cavity formed in said impact ram for receiving therein said body portion, said cavity including a wall portion disposed adjacent said exterior surface of said body portion and being formed with a second groove therein disposed in facing relation to said first groove in said body portion; and (c) an intermediate connecting member formed of resilient material and captured within both said first and second facing grooves for transmitting forces between said piston rod and said impact ram, said intermediate connecting member being the sole connection between said piston rod and said impact ram for transmitting at least the major driving force between said piston rod and said impact ram, and said intermediate connecting member having an axial thickness that is greater that its radial thickness.

* * * * *